US007794439B2

(12) United States Patent
Motsch et al.

(10) Patent No.: US 7,794,439 B2
(45) Date of Patent: Sep. 14, 2010

(54) UPRIGHT-STABILIZING PACKAGING FOR DISPOSABLE DIAPERS

(75) Inventors: Andreas Peter Motsch, Waldems (DE); Beate Christine Janik, Kelkheim (DE); Martin Werner Frank, Bad Vilbel (DE)

(73) Assignee: The Procter & Gamble Company, Cincinnati, OH (US)

( * ) Notice: Subject to any disclaimer, the term of this patent is extended or adjusted under 35 U.S.C. 154(b) by 446 days.

(21) Appl. No.: 11/074,101

(22) Filed: Mar. 7, 2005

(65) Prior Publication Data

US 2006/0196796 A1 Sep. 7, 2006

(51) Int. Cl.
*A61F 13/15* (2006.01)
*B65D 65/32* (2006.01)
*B65D 65/28* (2006.01)

(52) U.S. Cl. ..... 604/385.01; 604/385.02; 206/440; 383/207; 383/204

(58) Field of Classification Search ..... 604/385.01, 604/385.02; 206/440; 383/66, 204, 207
See application file for complete search history.

(56) References Cited

U.S. PATENT DOCUMENTS

| | | | |
|---|---|---|---|
| 1,846,748 | A | 2/1932 | Palmer |
| 3,294,229 | A | 12/1966 | McConnell et al. |
| 4,940,464 | A | 7/1990 | Van Gompel et al. |
| 5,092,861 | A | 3/1992 | Nomura et al. |
| 5,246,433 | A | 9/1993 | Hasse et al. |
| 5,569,234 | A | 10/1996 | Buell et al. |
| 5,897,545 | A | 4/1999 | Kline et al. |
| 5,957,908 | A | 9/1999 | Kline et al. |
| 6,120,487 | A | 9/2000 | Ashton |
| 6,120,489 | A | 9/2000 | Johnson et al. |
| 6,393,749 | B1 | 5/2002 | Haupt |
| 2003/0233082 | A1 | 12/2003 | Kline et al. |
| 2003/0234199 | A1 | 12/2003 | Morita et al. |
| 2004/0134822 | A1 | 7/2004 | Otsubo |
| 2005/0121348 | A1 | 6/2005 | Clare et al. |

FOREIGN PATENT DOCUMENTS

| | | |
|---|---|---|
| DE | 17 22 310 U | 5/1956 |
| DE | 17 58 981 U | 12/1957 |

OTHER PUBLICATIONS

International Search Report—Jul. 13, 2006.

*Primary Examiner*—Jacqueline F. Stephens
(74) *Attorney, Agent, or Firm*—Charles R. Ware

(57) ABSTRACT

A stabilizer for the upright stabilizing of at least one disposable diaper product. The stabilizer may include a front panel, a bottom panel, a rear panel, and at least one standoff. In another exemplary stabilizer for the upright stabilizing of at least one disposable diaper product, the stabilizer may include a circumferential sleeve, a bottom panel, and at least one standoff.

13 Claims, 15 Drawing Sheets

UPRIGHT-STABILIZING PACKAGING FOR DISPOSABLE DIAPERS

FIELD OF THE INVENTION

This invention relates to packaging for storing disposable diaper products in a substantially upright position on a shelf.

BACKGROUND OF THE INVENTION

Consumer products are commonly sold in retail stores that market such products by placing them on store shelves. Many consumer products are free-standing (e.g., cereal boxes, cans of soup) such that they do not require a support apparatus to be placed on a shelf. Other consumer products, however, are not substantially free-standing. Of these non-substantially-free-standing products, some of them require a particular orientation on the shelf (e.g., packages that have oriented surface indicia). One particular example of interest is disposable diapers.

Many disposable diapers are packaged in flexible film (e.g., low density polyethylene). Once packaged, the resulting package shape is generally rectangular in shape. Such rectangular shapes typically have a larger front and rear surface which provides the most surface area for the placement of surface indicia (e.g., graphics, text, pictures). However, basic scientific principles (e.g., center of gravity) dictate that the rectangular shape package is most stabile when placed on one of these larger surfaces. Thus, the surface indicia is not seen by the consumer, especially when one package is stacked on top of another. If the consumer can not find their desired product on the shelf amongst a multitude of stacked packages, then the consumer is unlikely to purchase your product. Furthermore, when the consumer searches through the several stacks, they are more likely to mix the product versions with one another. In addition to the consumer's frustrations, the store clerk has similar difficulties when attempting to determine reorder amounts and proper product placement.

In an attempt to solve such problems, some retailers have incorporated the use of shelf tray apparatus. While the use of such devices help to provide vertical support for disposable diapers, they have many drawbacks including (a) the need to constantly move forward remaining disposable diapers once a consumer removes a leading disposable diaper from the shelf and (b) the same shelf tray apparatus is repeatedly used and thus subsequently damaged over time.

What is needed is individual packaging for disposable diapers that provides upright support. Further, what is needed is individual packaging for disposable diapers that is integral to the diapers themselves such that said packaging is also carried away by the consumer.

SUMMARY OF THE INVENTION

A stabilizer for the upright stabilizing of at least one disposable diaper product. The stabilizer may include a front panel, a bottom panel, a rear panel, and at least one standoff. The front panel is oriented substantially vertical. The front panel may include an outward-facing surface and an inward-facing surface. The outward-facing surface being positioned away from the disposable diaper product. The outward-facing surface being of sufficient size to accommodate communication being placed thereon. The inward-facing surface being positioned towards the disposable diaper product. The front panel having a top end and a bottom end. The bottom panel being oriented substantially horizontal. The bottom panel having a downward-facing surface and an upward-facing surface. The upward-facing surface being positioned towards the disposable diaper product. The upward-facing surface being of sufficient rigidity to provide substantial support of the disposable diaper product. The downward-facing surface being positioned away from the disposable diaper product. The bottom panel having a front end and a rear end. The front end being joined to the bottom end of the front panel. The rear panel being oriented substantially vertical. The rear panel having an outward-facing surface and an inward-facing surface. The outward-facing surface being positioned away from the disposable diaper product. The inward-facing surface being positioned towards the disposable diaper product. The rear panel having a top end and a bottom end. The bottom end being joined to the rear end of the bottom panel. The at least one standoff being joined to the bottom panel. The stabilizer may include additional standoffs.

In another exemplary stabilizer for the upright stabilizing of at least one disposable diaper product, the stabilizer may include a circumferential sleeve, a bottom panel, and at least one standoff. The circumferential sleeve being oriented substantially vertical. The circumferential sleeve having an outward-facing surface and an inward-facing surface. The outward-facing surface being positioned away from the disposable diaper product. The outward-facing surface being of sufficient size to accommodate communication being placed thereon. The inward-facing surface being positioned towards the disposable diaper product. The circumferential sleeve having a top end and a bottom end. The bottom panel being oriented substantially horizontal. The bottom panel having a downward-facing surface and an upward-facing surface. The upward-facing surface being positioned towards the disposable diaper product. The upward-facing surface being of sufficient rigidity to provide substantial support of the disposable diaper product. The downward-facing surface being positioned away from the disposable diaper product. The bottom panel being joined to the circumferential sleeve. The bottom panel may have a circumference which is different from that of a circumference of the circumferential sleeve. The at least one standoff being joined to said bottom panel. The stabilizer may include additional standoffs.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. None of the drawings are necessarily to scale.

DETAILED DESCRIPTION OF THE INVENTION

Figure 1:
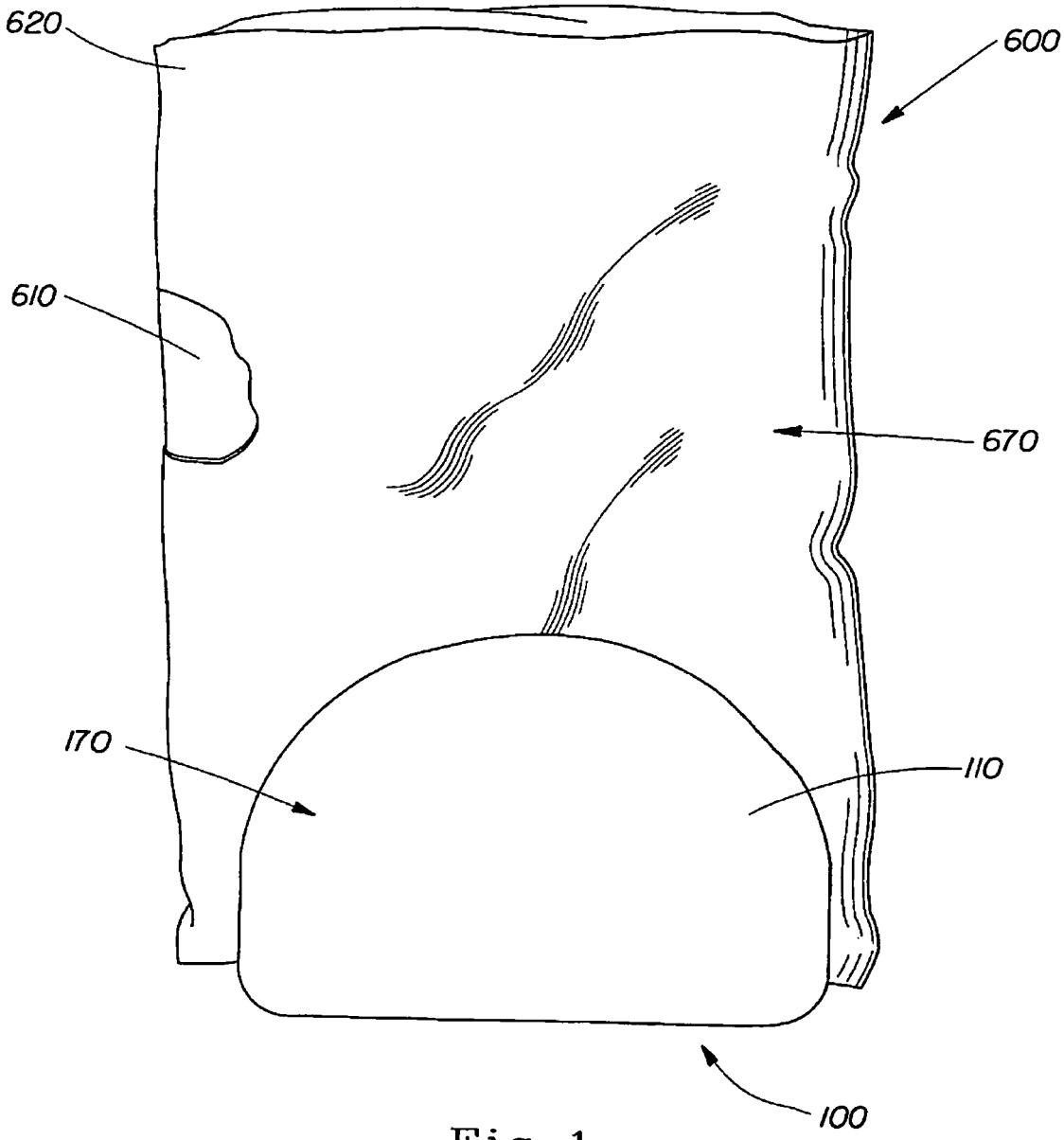
FIG. 1 shows an exemplary stabilizer and an exemplary disposable diaper product in accordance with the present invention.

Definitions:

The term "disposable" is used herein to describe absorbent articles which generally are not intended to be laundered or otherwise restored or reused as absorbent articles (i.e., they are intended to be discarded after a single use and, preferably, to be recycled, composted or otherwise discarded in an environmentally compatible manner).

The term "diaper" herein refers to an absorbent article generally worn by infants and incontinent persons about the lower torso.

The term "absorbent article" herein refers to devices which absorb and contain body exudates and, more specifically, refers to devices which are placed against or in proximity to the body of the wearer to absorb and contain the various exudates discharged from the body. Said absorbent article may have an absorbent core having a garment surface and a body surface; a liquid permeable topsheet positioned adjacent said body surface of said absorbent core; and a liquid impermeable backsheet positioned adjacent said garment surface of said absorbent core.

The term "pant", as used herein, refers to disposable absorbent articles having a waist opening and leg openings designed for infant or adult wearers. A pant may be placed in position on the wearer by inserting the wearer's legs into the leg openings and sliding the pant into position about the wearer's lower torso. A pant may be preformed by any suitable technique including, but not limited to, joining together portions of the article using refastenable and/or non-refastenable bonds (e.g., seam, weld, adhesive, cohesive bond, fastener, etc.). A pant may be preformed anywhere along the circumference of the article (e.g., side fastened, front waist fastened). While the term "pant" is used herein, pants are also commonly referred to as "closed diapers", "prefastened diapers", "pull-on diapers", "training pants" and "diaper-pants". Suitable pants are disclosed in U.S. Pat. No. 5,246,433, issued to Hasse, et al. on Sep. 21, 1993; U.S. Pat. No. 5,569,234, issued to Buell et al. on Oct. 29, 1996; U.S. Pat. No. 6,120,487, issued to Ashton on Sep. 19, 2000; U.S. Pat. No. 6,120,489, issued to Johnson et al. on Sep. 19, 2000; U.S. Pat. No. 4,940,464, issued to Van Gompel et al. on Jul. 10, 1990; U.S. Pat. No. 5,092,861, issued to Nomura et al. on Mar. 3, 1992; U.S. patent application Ser. No. 10/171,249, entitled "Highly Flexible And Low Deformation Fastening Device", filed on Jun. 13, 2002; U.S. Pat. No. 5,897,545, issued to Kline et al. on Apr. 27, 1999; U.S. Pat. No. 5,957,908, issued to Kline et al on Sep. 28, 1999.

The term "machine direction (MD)" or "longitudinal" herein refers to a direction running parallel to the maximum linear dimension of the article and/or fastening material and includes directions within ±45° of the longitudinal direction.

The term "cross direction (CD)", "lateral" or "transverse" herein refers to a direction which is orthogonal to the longitudinal direction.

The term "joined" encompasses configurations whereby an element is directly secured to another element by affixing the element directly to the other element, and configurations whereby an element is indirectly secured to another element by affixing the element to intermediate member(s) which in turn are affixed to the other element.

The term "babies" ("baby" in singular) is intended to describe persons ranging in age from newborn to about 2-7 years old. Young children often referred to variously as toddlers, pre-school aged children, or even school aged children all come within this definition. It is specially contemplated that the definition of babies as used herein will encompass children of an age who can talk and have greater dexterity, motor skills and the like than younger babies (for example, as compared to newborn babies). Such older babies (as the term is used herein) may be able to use baby wet wipes products themselves while younger babies may need a caregiver to use the product on them. There is no single upper age limit for babies (as that term is used herein) and it will be recognized that babies progress through stages of development at differing rates. The characteristics of the stages and situations (described in greater detail below) may be more significant than the typical age ranges associated with such stages and situations. Age ranges are by necessity averages and generalities. The ability of the line ups of the present invention to target on the basis of situation and stage (as determined without strict reference to age) is one of its benefits. While no particular upper age limit exists for babies, it is typical that those making the ultimate purchase decision with respect to particular products in the line up will not be a baby within the meaning defined above. In other words, even though older babies may be involved in the use and purchase of baby wipes for their stage or use situation, they often will not make the entire purchase decision on their own (as an example, a 5 year old might tell his or her parent what product he or she desires, but ultimately the parent makes the decision to purchase or not).

Description:

FIG. 1 shows an exemplary stabilizer 100 and an exemplary disposable diaper product 600 in accordance with the present invention. Stabilizer 100 is shown while in use such that an exemplary disposable diaper product 600 is supported in a substantially upright position. Stabilizer 100 may comprise a front panel 110 which is adapted to provide said upright support. Front panel 110 may also include communication 170. Communication 170 may include a variety of information including, but not limited to diaper size, diaper quantity, baby stages of development classifications, ornamental features, etc. Disposable diaper product 600 may comprise a plurality of individual disposable diapers 610 being packaged within a wrapping layer 620. Disposable diaper product 600 may also have communication 670. Communication 670 may include a variety of information including, but not limited to, brand-name, diaper size, diaper quantity, baby stages of development classifications, ornamental features, etc.

Figure 2:
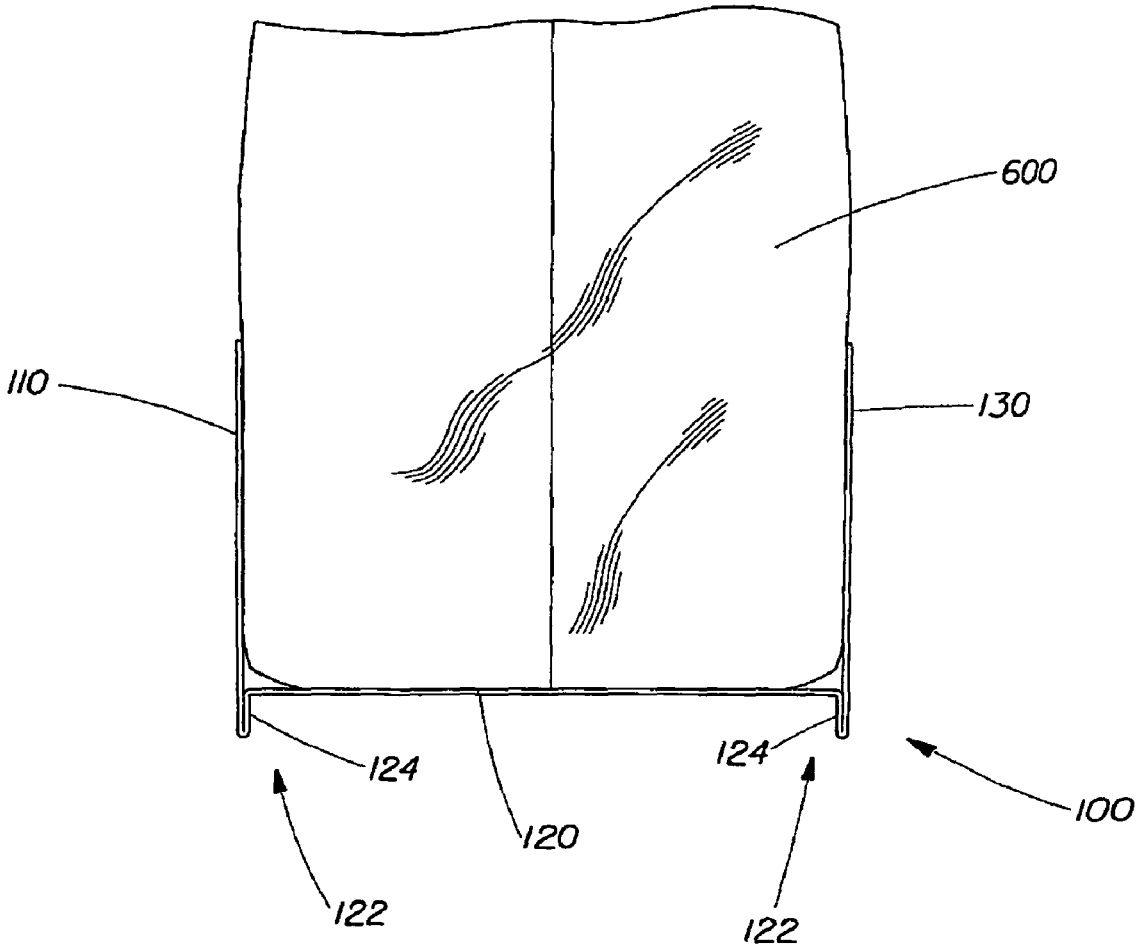
FIG. 2 shows a partial, right side elevational view of the stabilizer and disposable diaper product from that of FIG. 1.

FIG. 2 shows a partial, right side elevational view of stabilizer 100 and disposable diaper product 600 from that of FIG. 1. In this view, it may be further appreciated that stabilizer 100 provides substantially upright support for said disposable diaper product. Said stabilizer may be constructed of corrugated carton board (e.g., N- or F- or E-flute), full carton board, plastic board, formed plastic sheets or any other suitable material. Said stabilizer's height, weight or similar characteristics may vary so long as the stored disposable diaper product is sufficiently supported. For some disposable diaper products, it has been found that the minimum height of said stabilizer should be equal to about ⅕ of the disposable diaper product height.

In this particular exemplary design, stabilizer 100 includes a front panel 110, a bottom panel 120 and a rear panel 130. Further, stabilizer 100 may include at least one standoff 122 so as to provide liftable support of disposable diaper product 600. Standoff 122 may be constructed in a variety of ways including, but not limited to, the folding of the outer edges of bottom panel 120 thus resulting in a vertical standoff portion 124. Another such exemplary construction of standoff 122 may include the inclusion of another material to serve as vertical standoff portion 124.

Figure 3:
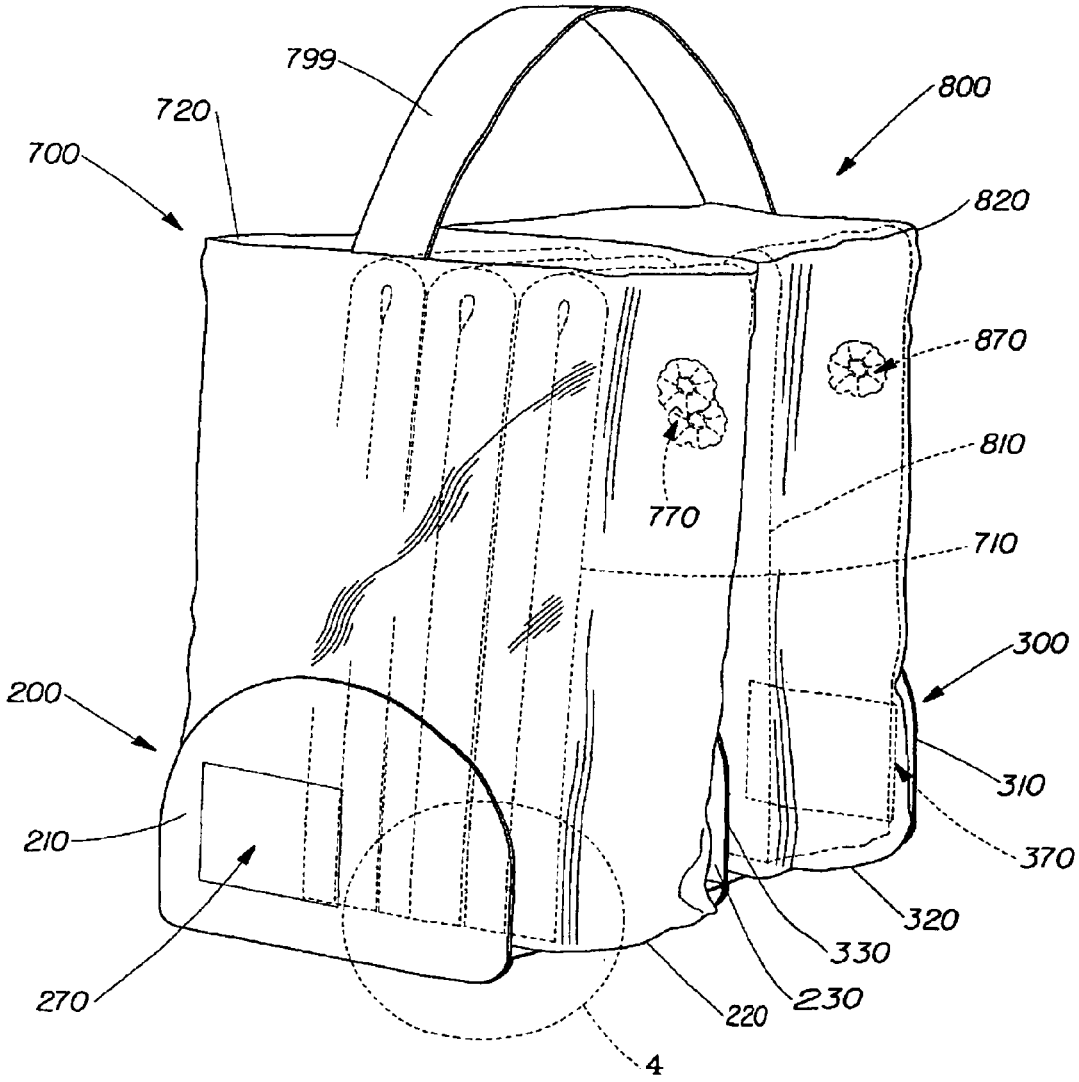
FIG. 3 shows another exemplary stabilizer and another exemplary disposable diaper product.

FIG. 3 shows other exemplary stabilizers 200, 300 and exemplary disposable diaper products 700, 800 in accordance with the present invention. Stabilizer 200, 300 are joined to each other at rear panels 230, 330 such that a dual pack of disposable diaper products 700, 800 is formed and supported in a substantially upright position. Stabilizer 200 may comprise of a front panel 210 which is adapted to provide said upright support. Said front panel 210 may also include communication 270. Communication 270 may include a variety of information including, but not limited to, diaper size, diaper quantity, baby stages of development classifications, ornamental features, etc. Stabilizer 200 may comprise a bottom panel 220, and a rear panel 230. Second stabilizer 300 may comprise a rear panel 330 (which may be joined to first stabilizer rear panel 230), a bottom panel 340 and a front panel 310. Said front panel 310 may also include communication 370. Communication 370 may include a variety of information including, but not limited to, diaper size, diaper quantity, baby stages of development classifications, ornamental features, etc. Disposable diaper product 700 may comprise a plurality of disposable diapers 710 which are packaged within a wrapping layer 720. Similarly, disposable diaper product 800 may comprise a plurality of disposable diapers 810 which are packaged within a wrapping layer 820. Said diaper products may include communication 770, 870, respectively. It may also be desirable to include a handle 799 such that said diaper products 700, 800 may be conveniently carried by the consumer and/or store clerk. Said handle 799 may be made of any suitable materials (e.g., plastic film such as polyethylene) and attached in any suitable manner (e.g., adhesive).

Figure 4:
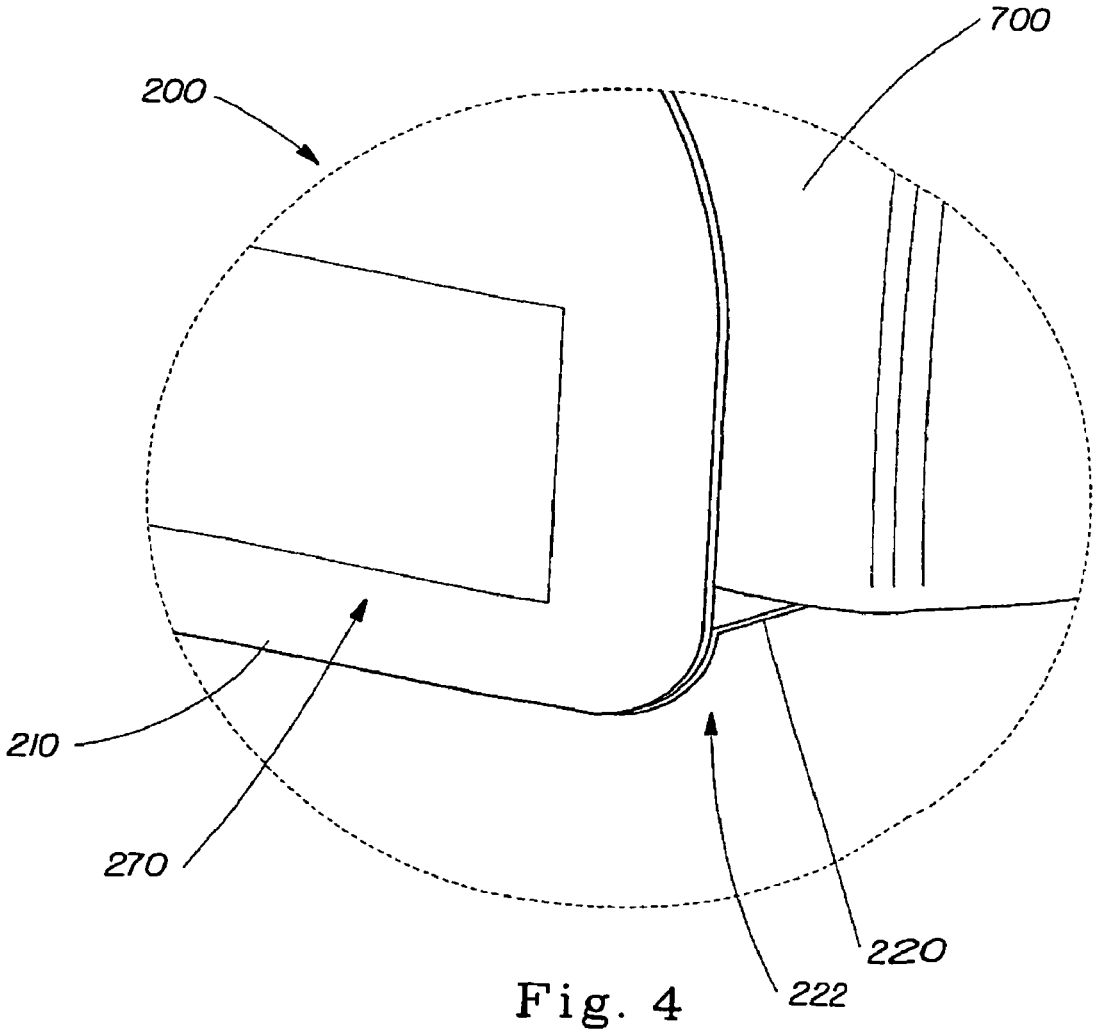
FIG. 4 shows a close-up view of a standoff from that of FIG. 3.

FIG. 4 shows a close-up view of standoff 222 from that of FIG. 3. Said standoff provides additional upright stability. Said standoffs may be constructed in a variety of shapes including, but not limited to, round, square, rectangular, "W"-shaped. The width of said standoff(s) may vary. In an exemplary embodiment, the standoff may be about equal to the width of the stabilizer. In another exemplary embodiment, the standoff may be narrower or wider than the width of the stabilizer. Depending on the overall size of the disposable diaper product, it may be desirable to design the standoffs) to have a minimum width equal to about 20% of the disposable diaper product width in order to achieve sufficient stability. In another exemplary embodiment, the standoff may consist of two or more discontinuous elements, either linearly or non-linearly aligned. The height of the standoff may also vary. Depending on the overall size of the disposable diaper product, it may be desirable to design the standoffs to have a height of about 6 mm to 20 mm for a corrugated carton board, other materials may require different heights.

Figure 5:
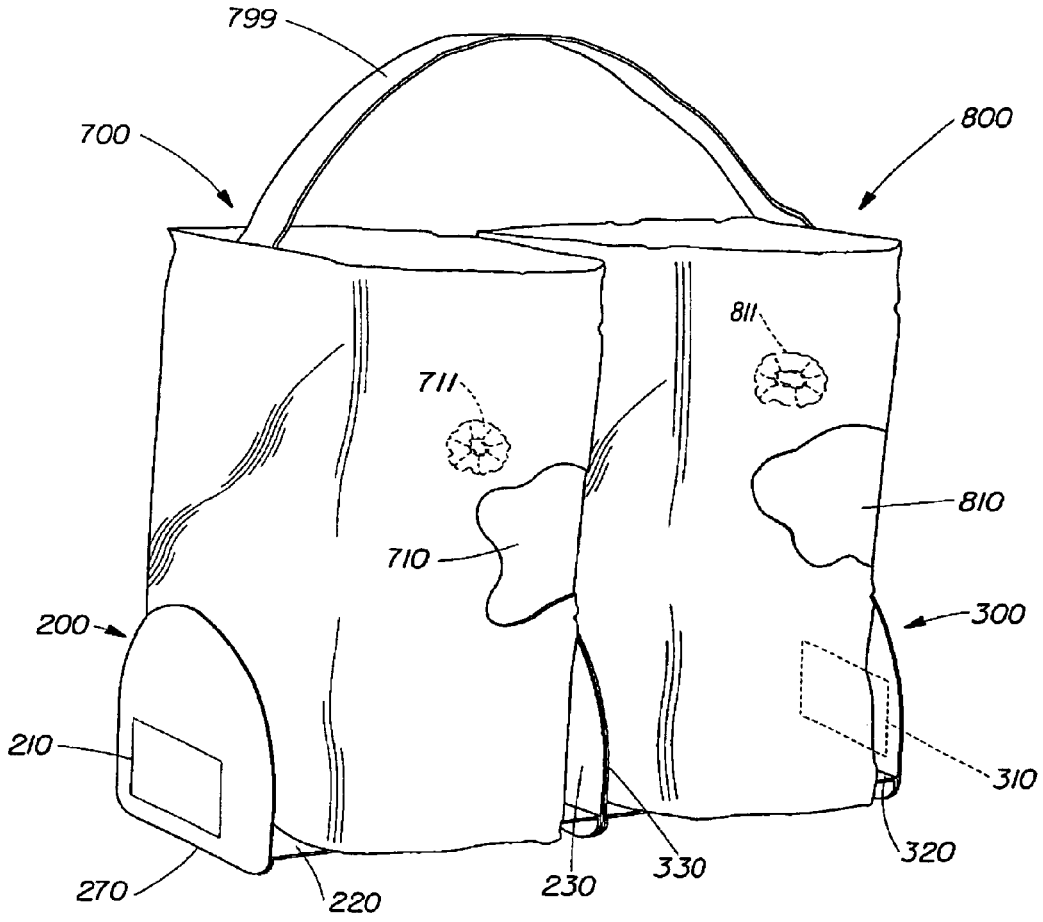
FIG. 5 shows an alternate perspective view of the stabilizer and disposable diaper product from that of FIG. 3.

FIG. 5 shows another perspective view of stabilizers 200, 300 and disposable diaper products 700, 800 so as to further demonstrate the construction of stabilizers 200, 300 and to demonstrate the capability of viewing of graphics 711, 811 which are printed on disposable diapers 710, 810, respectively. Because the wearers of said diapers often prefer particular graphics (e.g., cartoon characters), being able to view said graphics is important in the marketing of disposable diaper products.

Figure 6:
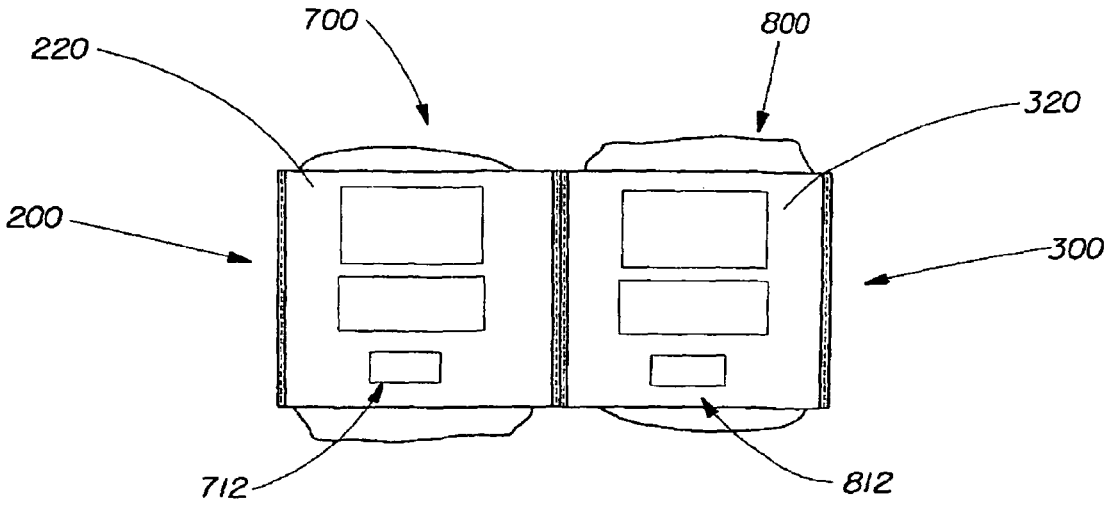
FIG. 6 shows a bottom view of the stabilizer and disposable diaper product from that of FIG. 3.
Figure 7:
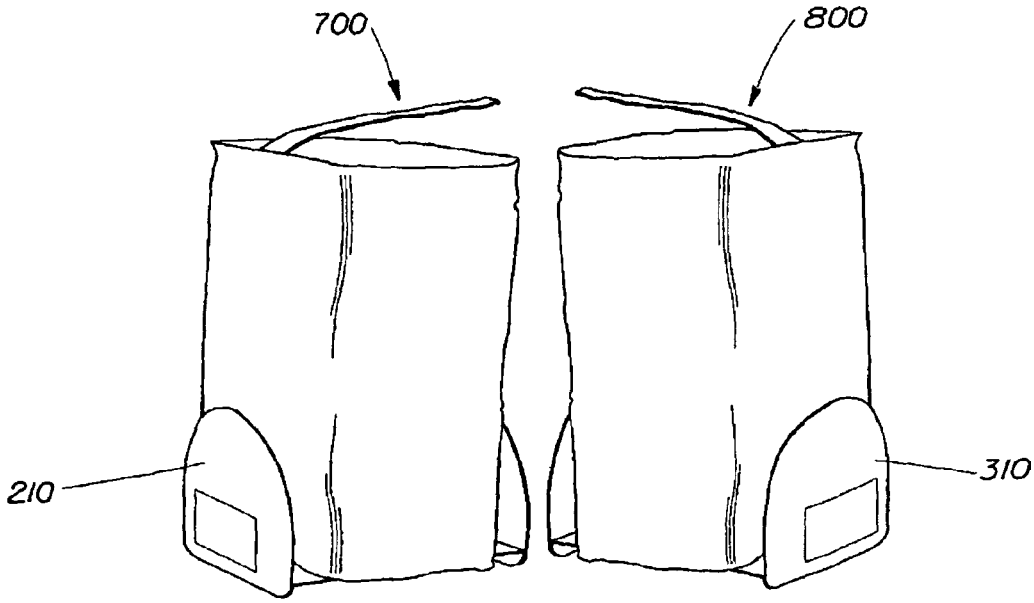
FIG. 7 shows the stabilizer and disposable diaper products from that of FIG. 6 being separated into two distinct products.

FIG. 6 shows the bottom view of stabilizers 200, 300 from that of FIG. 3. In this view, one can appreciate that disposable diaper product 700 and disposable product 800 may optionally contain their own product information (e.g., UPC code). In this way, a retailer and/or consumer may decide to sell or purchase, respectively, the combination of diaper products or each diaper product separately. FIG. 7 shows disposable diaper products 700, 800 being separated to facilitate the individual purchase and/or use of said products.

Figure 8:
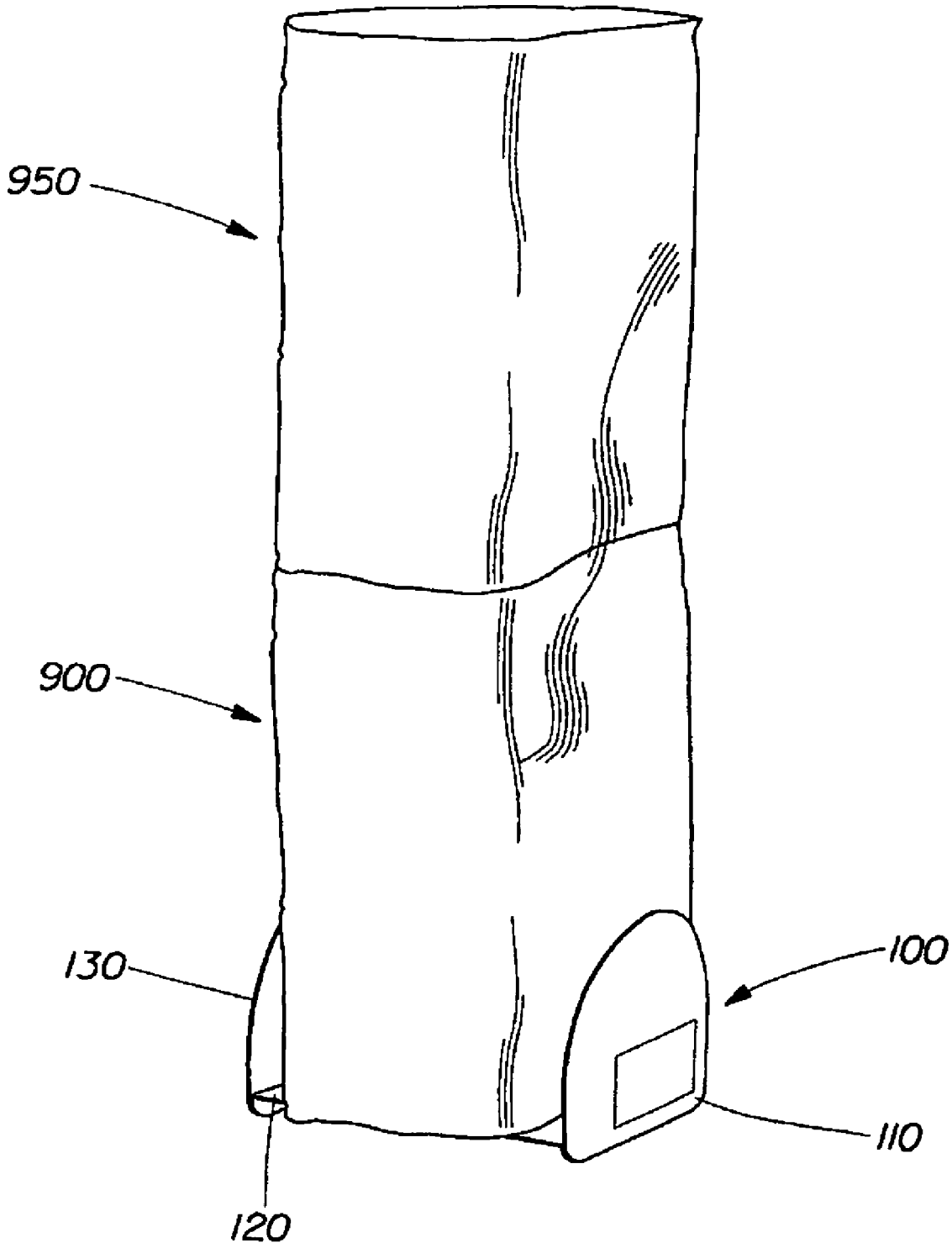
FIG. 8 shows an exemplary stabilizer and a substantially vertical package of disposable diapers.

FIG. 8 shows stabilizer 100 supporting an alternative collection of disposable diapers, more specifically, a vertical dual-stack of disposable diapers 900, 950. Such a configuration of stabilizer 100 and disposable diapers 900, 950 provide a substantially vertical display of products that require minimal shelf footprint while providing a unique visual display of said products.

Figure 9:
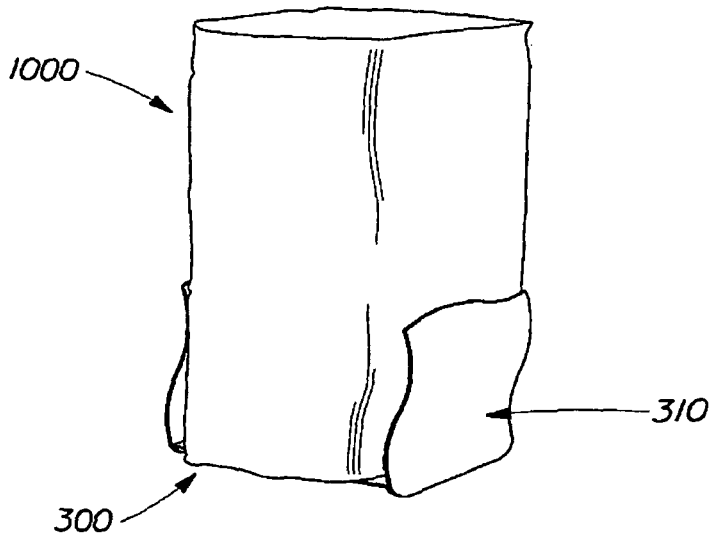
FIG. 9 shows another exemplary stabilizer and an exemplary disposable diaper product.

FIG. 9 shows another exemplary stabilizer 300 having a front panel 310 being shaped with nonlinear edges. Such an alternative form/construction of front panel 310 may provide a more aesthetically pleasing display for the consumer. One skilled in the art would recognize that other forms/constructions of front panel 310 may be used to provide aesthetically-pleasing displays for the consumer. Additionally, because stabilizer does not contain diaper specific information, rather only brand information, said stabilizer may be used to support a variety of brand related disposable diaper products.

Figure 10:
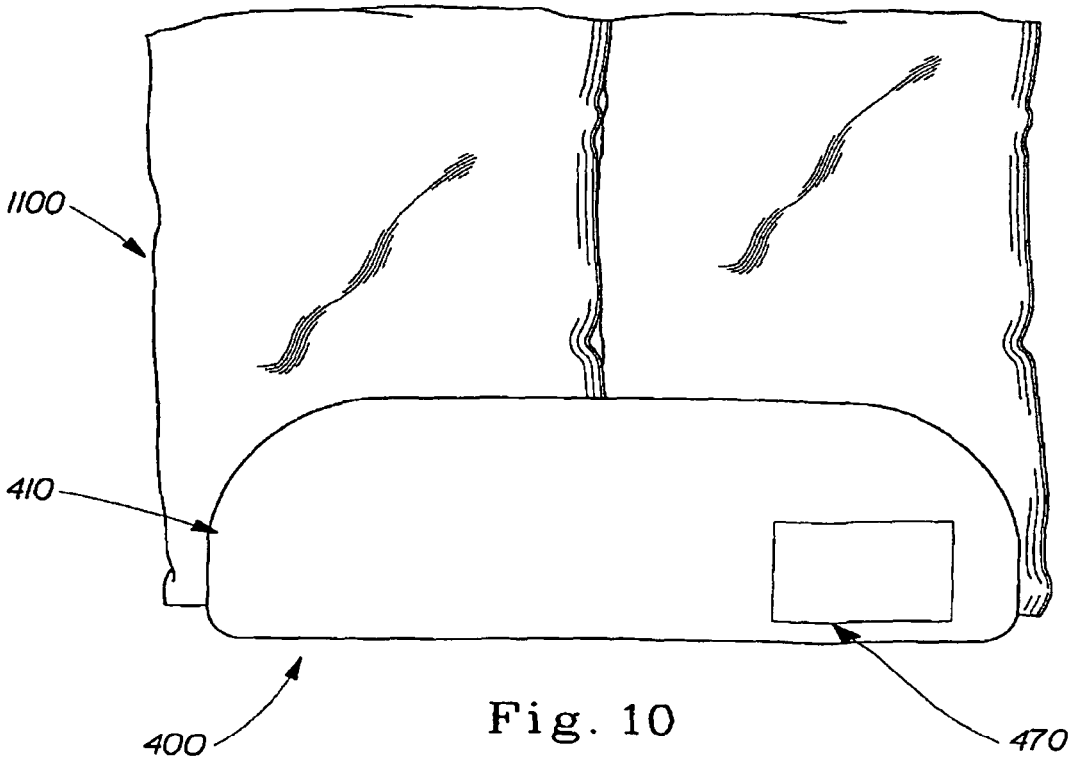
FIG. 10 shows another exemplary stabilizer and an exemplary dual pack of disposable diaper products.

FIG. 10 shows another exemplary stabilizer 400 adapted to provide upright support for a larger pack of disposable diapers, more specifically, a vertical high count single-stack of disposable diapers 1100. Said stabilizer 400 having a front panel 410 being of a bigger size/shape. Said front panel may include communication 470. Communication 470 may include a variety of information including, but not limited to, brand-name, diaper size, diaper quantity, baby stages of development classifications, ornamental features, etc. The use of a relatively larger-sized front panel 410 and respective communication 470 may communicate to the consumer that the product contains a higher quantity of packaged diapers. Such immediate recognition of such fact may assist the consumer while quickly shopping.

Figure 11:
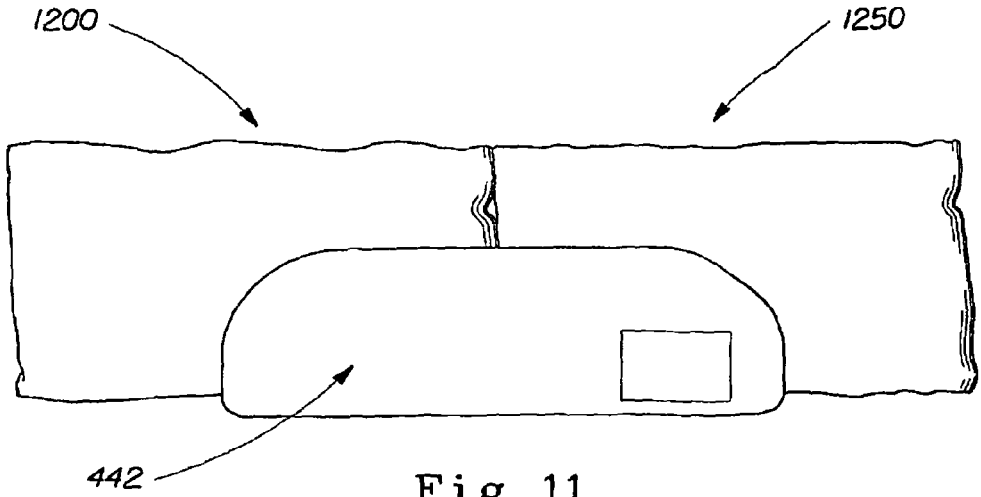
FIG. 11 shows another exemplary stabilizer and an exemplary dual pack of disposable diaper products being oriented in a substantially horizontal fashion.

FIG. 11 shows another exemplary stabilizer 442 being adapted to provide upright support for a larger pack of disposable diapers, more specifically, a horizontal dual-stack of disposable diapers 1200, 1250.

Figure 12:
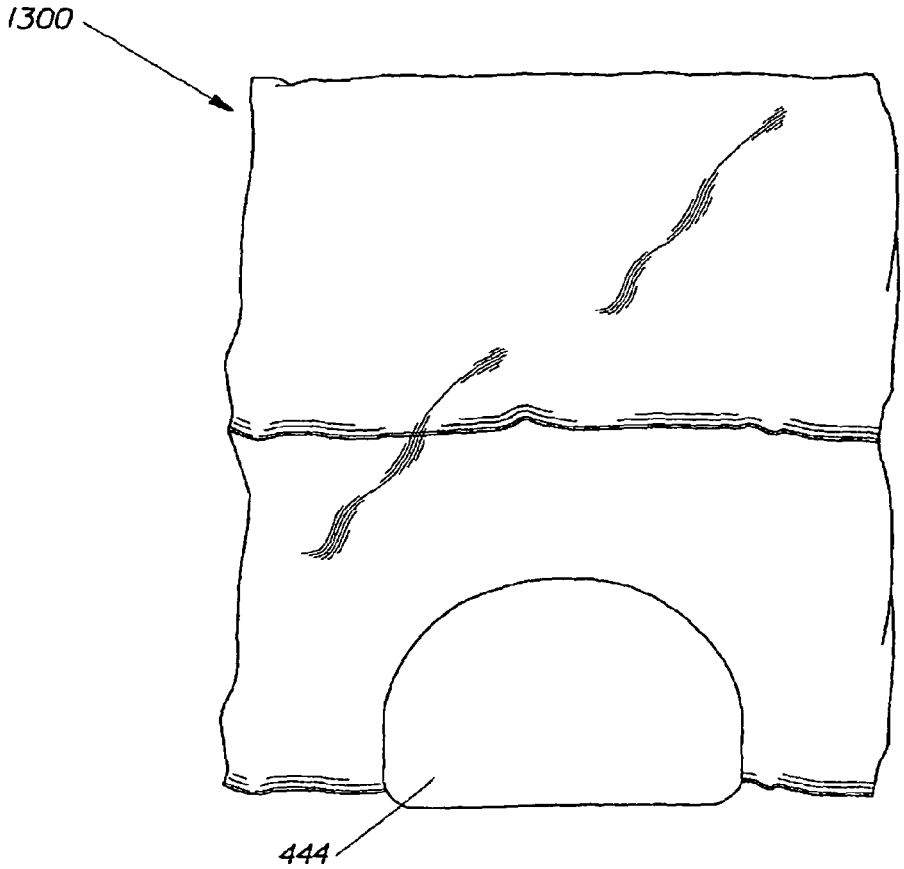
FIG. 12 shows another exemplary stabilizer and an exemplary disposable diaper product having minimal product communication.

FIG. 12 shows another exemplary stabilizer 444 adapted to provide upright support for a single-stack of horizontally packaged disposable diapers. Similar to that of FIG. 11, disposable diaper product 1300 may be packaged in a wrapping layer containing minimal product information thus providing maximal viewing of the enclosed disposable diapers.

Figure 13:
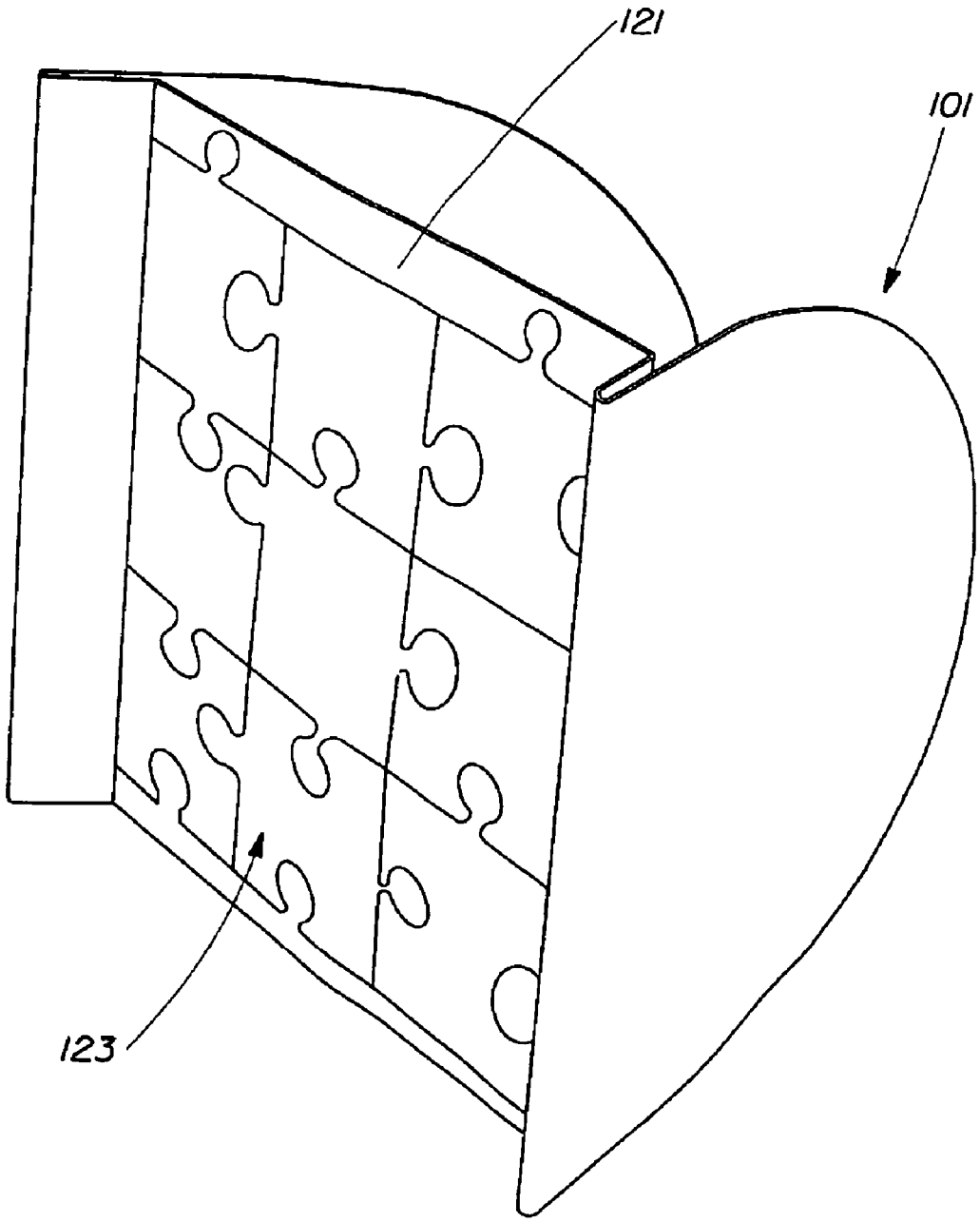
FIG. 13 shows another exemplary stabilizer having a puzzle disposed on the underneath side of its bottom panel.

FIG. 13 shows another exemplary stabilizer 101 which is substantially similar to stabilizer 100 from that of FIG. 1 except that stabilizer 101 also includes materials attached to or part of bottom panel 121. In this particular example, a puzzle 123 is made part of bottom panel 121 such that said bottom panel may be separated into discrete pieces for use as a puzzle. Alternatively, puzzle 123 may be attached to said bottom panel 121 and then subsequently removed for use.

Figure 14:
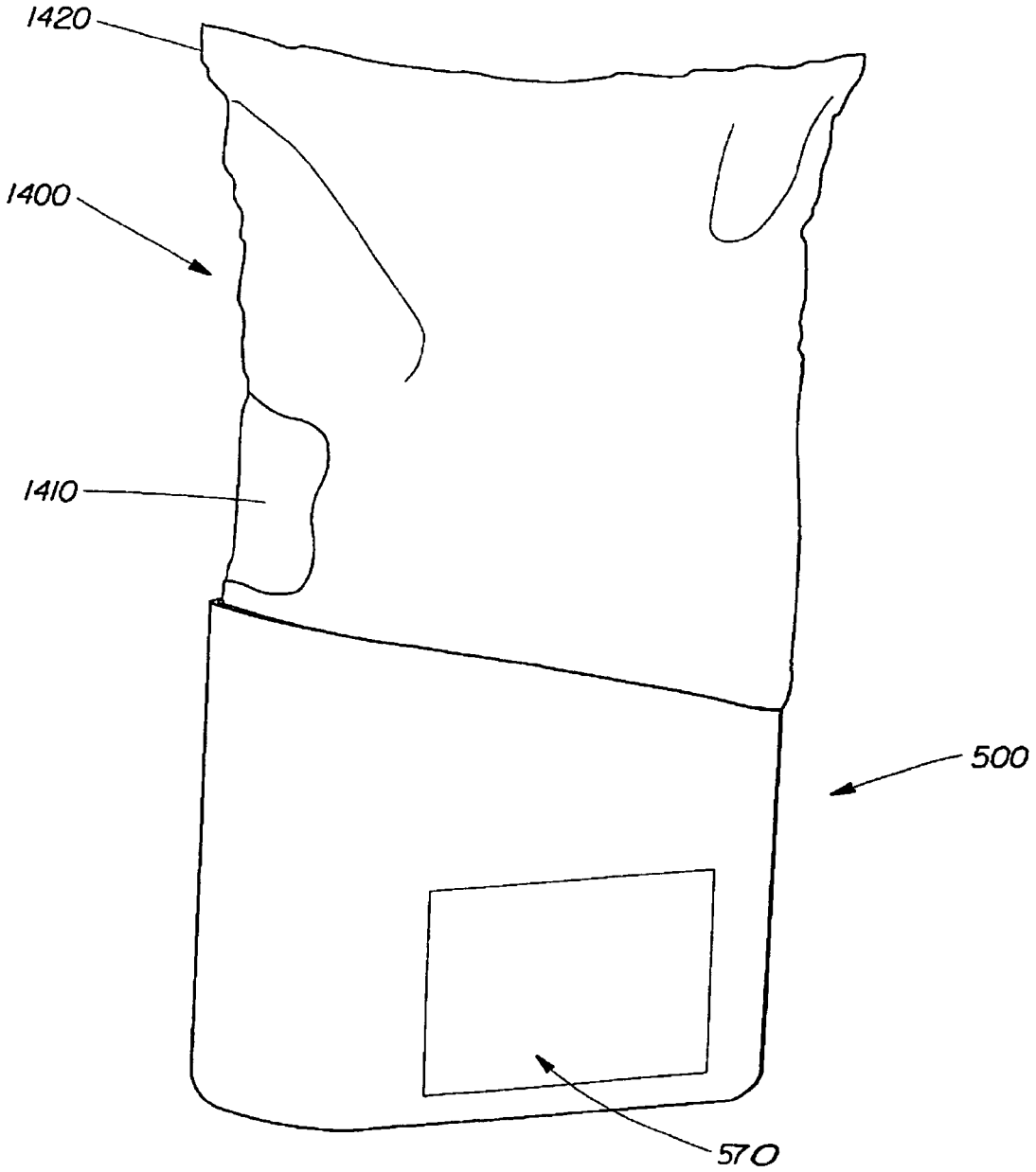
FIG. 14 shows another exemplary stabilizer which provides circumferential support of a disposable diaper product.

FIG. 14 shows another exemplary stabilizer 500 which is adapted to provide circumferential support of disposable diaper products 1400. Said disposable diaper product 1400 includes at least one disposable diaper 1410 being packaged in a wrapping layer 1420. In this particular example, stabilizer 500 may not extend the entire height of said disposable diaper product such that the graphics of disposable diaper 1410 may be viewable to the consumer. In this particular example, stabilizer 500 may also include communication 570 which provides diaper specific information.

Figure 15:
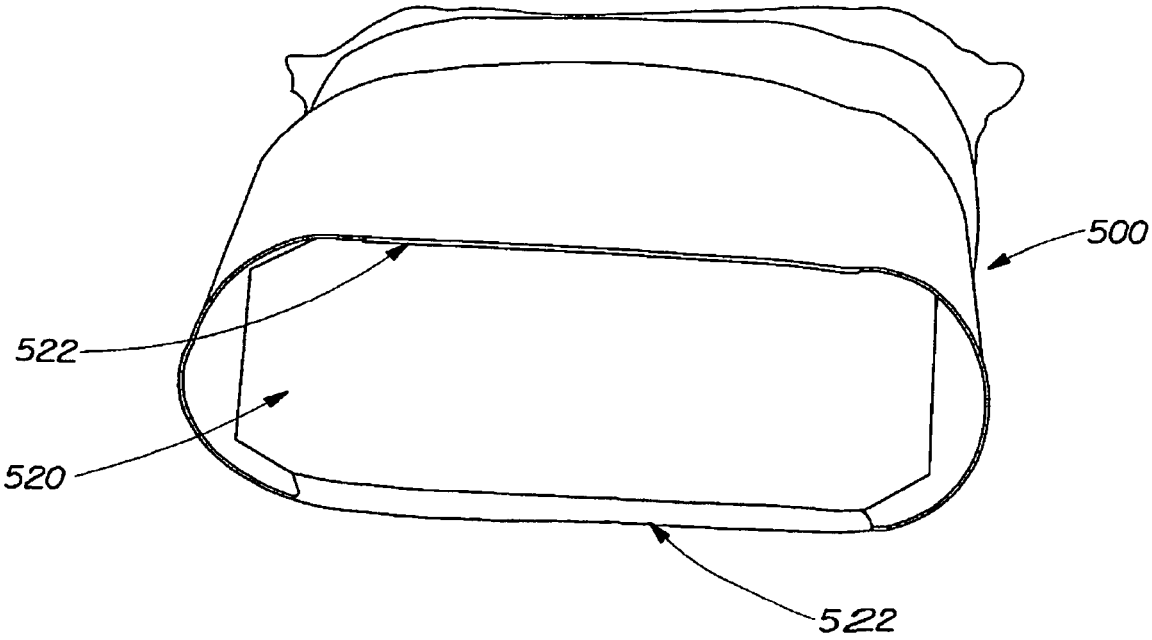
FIG. 15 shows a perspective, bottom view of the stabilizer and disposable diaper product from that of FIG. 14.

FIG. 15 shows a perspective, bottom view of the stabilizer 500 from that of FIG. 14. This view shows standoffs 522 and bottom panel 520 of the stabilizer. Bottom panel 520 may or may not have a circumference substantially equal to the circumference of said circumferential sleeve.

Figure 16:
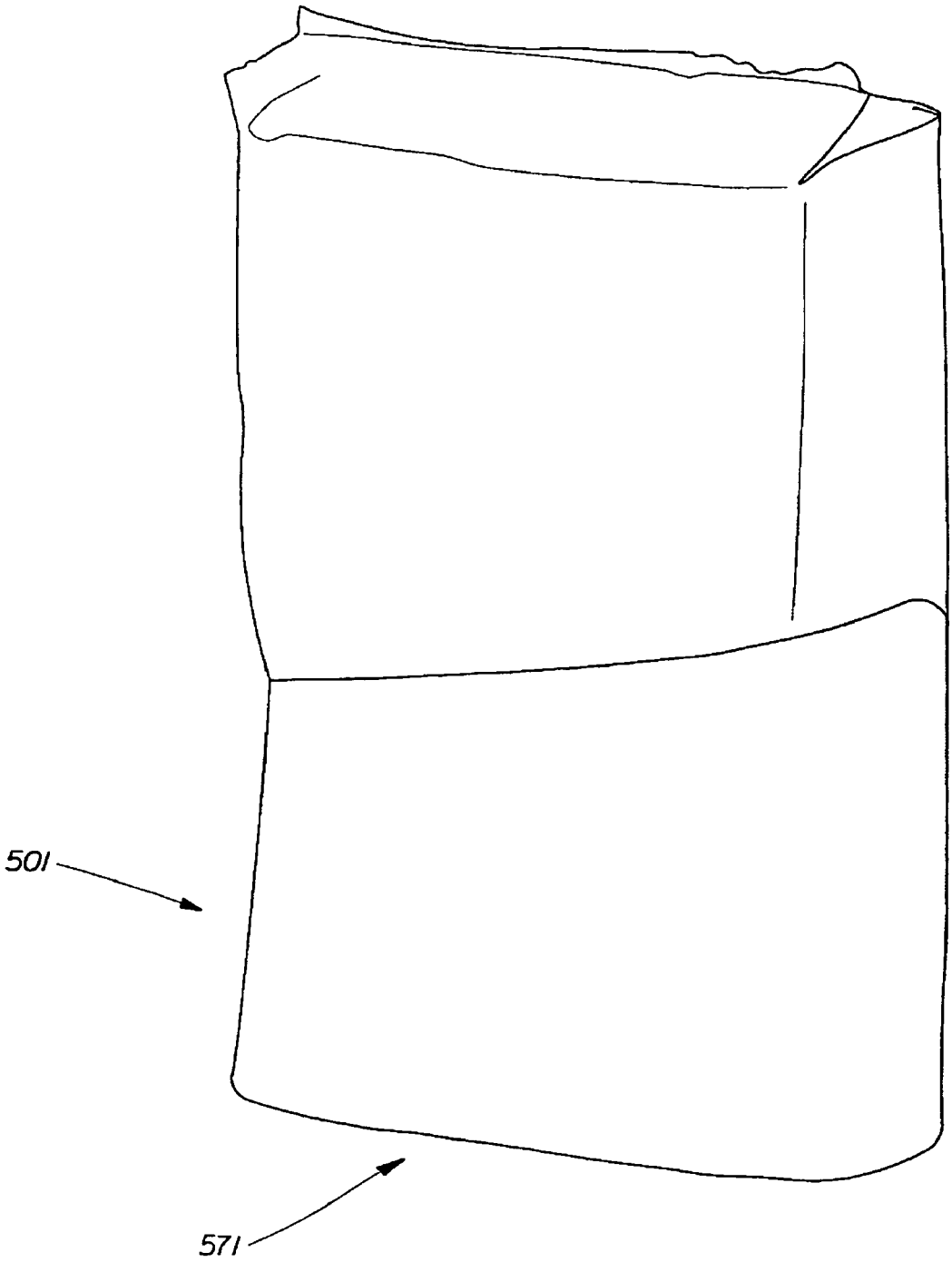
FIG. 16 shows another exemplary stabilizer which provides circumferential support of a disposable diaper product, said stabilizer having minimal product-specific information.

Alternatively, FIG. 16 shows another exemplary stabilizer 501 having minimal communication 571, more specifically, said communication 571 only includes brand specific information such that stabilizer 501 may be used to provide support for a variety of brand related disposable diaper products.

Figure 17:
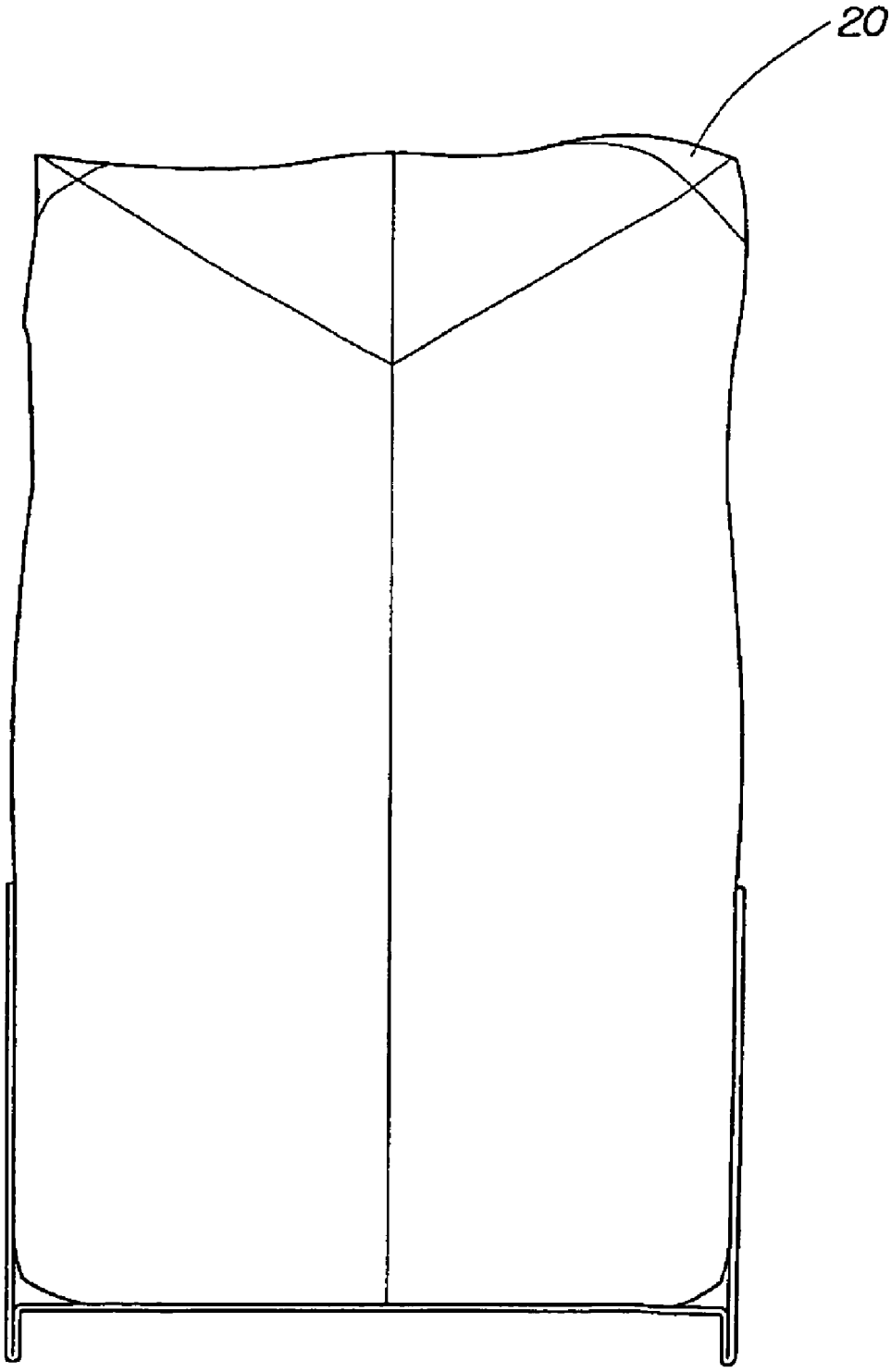
FIG. 17 shows both an exemplary stabilizer and an exemplary disposable diaper product being enclosed in a wrapping layer.

Referring now to FIG. 17, wrapping layer 20 is shown to surround the disposable diaper and the stabilizer. Alternatively, one skilled in the art would also appreciate that the wrapping layer 20 may be applied so as not to surround the stabilizer. Further, one skilled in the art would also appreciate that film 20 need not necessarily entirely encompass all of said disposable diapers and/or stabilizer.

Figure 18:
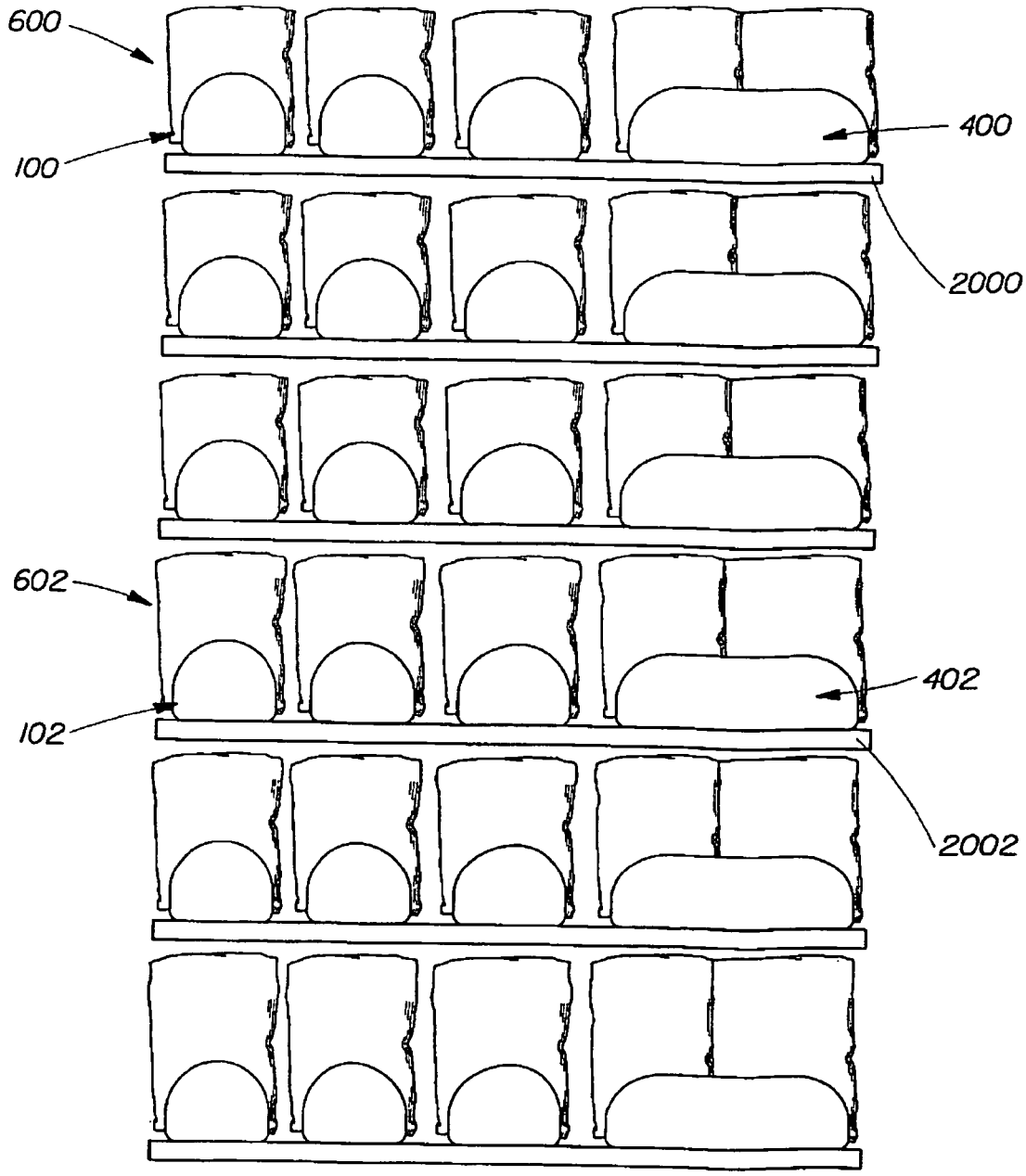
FIG. 18 shows a product lineup display of a variety of exemplary stabilizers and exemplary disposable diaper products in accordance with the present invention.

FIG. 18 shows an exemplary product display of an assortment of disposable diapers and stabilizers. Such product display achieves a clean and organized appearance. In this particular example, one particular type of disposable diapers 600 (e.g., size 4) is shown in differing packaged quantities (100, 400) on the same shelf 2000, while another type of disposable diapers 602 (e.g., size 5) is shown in differing packaged quantities (102, 402) on another same shelf 2002. Such a product display would help the consumer to first find the correct type of disposable diaper and then select the desired quantity. One skilled in the art would recognize that other sorted presentations of disposable diaper products and stabilizers may be used to meet other marketing plans (e.g., sorting by baby stages of development classifications).

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A stabilizer for the upright stabilizing of at least one disposable diaper product, said stabilizer comprising:

a front panel, said front panel being oriented substantially vertical, said front panel having an outward-facing surface and an inward-facing surface, said outward-facing surface being positioned away from the disposable diaper product, said outward-facing surface being of sufficient size to accommodate communication being placed thereon, said inward-facing surface being positioned towards the disposable diaper product; said front panel having a top end and a bottom end;

a bottom panel, said bottom panel being oriented substantially horizontal, said bottom panel having an downward-facing surface and an upward-facing surface, said upward-facing surface being positioned towards the disposable diaper product, said upward-facing surface being of sufficient rigidity to provide substantial support of the disposable diaper product, said downward-facing surface being positioned away from the disposable diaper product, said bottom panel having a front end and a rear end, said front end being joined to said bottom end of said front panel;

a rear panel, said rear panel being oriented substantially vertical, said rear panel having an outward-facing surface and an inward-facing surface, said outward-facing surface being positioned away from the disposable diaper product, said inward-facing surface being positioned towards the disposable diaper product, said rear panel having a top end and a bottom end, said bottom end being joined to said rear end of said bottom panel; and at least one standoff, wherein the standoff supports the bottom panel such that at least a portion of the downward facing surface of the bottom panel is lifted vertically up off of a planar shelf surface on which the stabilizer is standing.

2. The stabilizer of claim 1 further comprising an additional standoff, said standoff being joined to said bottom panel.

3. The stabilizer of claim 1 wherein said front panel has a non-uniform height.

4. The stabilizer of claim 1 wherein said front panel is substantially symmetrical about a centrally-located vertical axis.

5. The stabilizer of claim 1 wherein said front panel is substantially asymmetrical about a centrally-located vertical axis.

6. The stabilizer of claim 1, wherein the disposable diaper product includes a plurality of individual disposable diapers.

7. The stabilizer of claim 1, wherein an overall vertical height of the stabilizer is at least about one fifth of an overall vertical height of the disposable diaper product.

8. The stabilizer of claim 1, wherein the standoff includes a folded portion of an outer edge of the bottom panel.

9. The stabilizer of claim 1, wherein an overall width of the standoff is about equal to an overall width of the stabilizer.

10. The stabilizer of claim 1, wherein the standoff has an overall height between 6 and 20 millimeters.

11. The stabilizer of claim 1, wherein the disposable diaper product is configured as a dual stack.

12. The stabilizer of claim 1, wherein the disposable diaper product is configured as a horizontal dual stack of disposable diapers.

13. The stabilizer of claim 1, wherein the disposable diaper product is configured as a vertical dual stack of disposable diapers.

* * * * *